US010247025B2

(12) United States Patent
Matsumoto et al.

(10) Patent No.: US 10,247,025 B2
(45) Date of Patent: Apr. 2, 2019

(54) ROTATING MACHINE

(71) Applicant: MITSUBISHI HEAVY INDUSTRIES, LTD., Tokyo (JP)

(72) Inventors: Kazuyuki Matsumoto, Tokyo (JP); Takaaki Kaikogi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 679 days.

(21) Appl. No.: 14/780,111

(22) PCT Filed: Jan. 30, 2014

(86) PCT No.: PCT/JP2014/052095

§ 371 (c)(1),
(2) Date: Sep. 25, 2015

(87) PCT Pub. No.: WO2014/162767

PCT Pub. Date: Oct. 9, 2014

(65) Prior Publication Data

US 2016/0047265 A1 Feb. 18, 2016

(30) Foreign Application Priority Data

Apr. 3, 2013 (JP) ..... 2013-078029

(51) Int. Cl.
*F01D 11/08* (2006.01)
*F01D 5/02* (2006.01)
(Continued)

(52) U.S. Cl.
CPC ..... *F01D 11/08* (2013.01); *F01D 5/02* (2013.01); *F01D 25/24* (2013.01); *F01D 5/225* (2013.01);
(Continued)

(58) Field of Classification Search
CPC . F01D 11/08; F01D 11/10; F01D 5/02; F01D 5/225; F01D 25/24; F05D 2220/31;
(Continued)

(56) References Cited

U.S. PATENT DOCUMENTS 3,092,393 A * 6/1963 Walton ..... F01D 11/08 277/414
3,572,728 A * 3/1971 Smuland ..... F01D 11/02 277/419
(Continued)

FOREIGN PATENT DOCUMENTS

CN 1038333 12/1989
GB 1 505 534 3/1978
(Continued)

OTHER PUBLICATIONS

JP,54-103910 English machine translation, p. 1-6, translated by J-PlatPat Mar. 18, 2018.*
(Continued)

*Primary Examiner* — Ninh H. Nguyen
*Assistant Examiner* — Wayne A Lambert
(74) *Attorney, Agent, or Firm* — Wenderoth, Lind & Ponack, L.L.P.

(57) ABSTRACT

A rotating machine includes a casing (10) having a cavity (12) that a tip of a rotor blade enters, a plurality of sealing fins (17) extending from an inner circumferential surface of the cavity (12) of the casing (10) toward the tip of the rotor blade (50) and configured to seal a space between the casing (10) and the rotor blade (50), and swirl breakers (2) disposed between the plurality of sealing fins, extending from the inner circumferential surface of the cavity (12) of the casing (10) inward in the radial direction, and having swirl flow collision surface (3) with which a swirl flow collides and swirl flow transmission parts (n) formed at at least parts of
(Continued)

the swirl flow collision surfaces (3) and through which the swirl flow passes in a circumferential direction.

12 Claims, 14 Drawing Sheets

(51) Int. Cl.
*F01D 25/24* (2006.01)
*F01D 5/22* (2006.01)

(52) U.S. Cl.
CPC ..... *F05D 2220/31* (2013.01); *F05D 2220/32* (2013.01); *F05D 2240/55* (2013.01); *F05D 2260/60* (2013.01)

(58) Field of Classification Search
CPC ..... F05D 2220/32; F05D 2240/55; F05D 2240/11; F05D 2260/60; F16J 15/447–15/453
USPC ..... 277/409, 411, 412, 418–421
See application file for complete search history.

(56) References Cited

U.S. PATENT DOCUMENTS 3,694,882 A * 10/1972 Desmond ..... F01D 11/127 277/411
4,017,207 A * 4/1977 Bell ..... F01D 11/08 415/115
4,057,362 A * 11/1977 Schwaebel ..... F01D 11/02 277/419
4,273,510 A * 6/1981 Ambrosch ..... F01D 11/08 415/110
4,370,094 A * 1/1983 Ambrosch ..... F01D 11/08 415/119
4,420,161 A * 12/1983 Miller ..... F01D 25/04 277/418
4,876,505 A * 10/1989 Osborne ..... F01D 21/04 324/207.25
5,088,889 A * 2/1992 Wolff ..... F01D 11/02 277/423
5,439,347 A * 8/1995 Brandon ..... F01D 11/08 277/423
5,540,447 A * 7/1996 Shultz ..... F01D 25/04 277/303
5,632,598 A * 5/1997 Maier ..... F01D 5/225 415/173.5
5,707,064 A * 1/1998 Vance ..... F01D 25/04 277/414
6,155,778 A * 12/2000 Lee ..... F01D 5/20 415/116
6,368,054 B1 * 4/2002 Lucas ..... F01D 11/08 415/135
6,402,464 B1 * 6/2002 Chiu ..... F01D 5/288 165/133
6,632,069 B1 * 10/2003 Naljotov ..... F01D 5/225 415/173.5
7,004,475 B2 2/2006 McHale
7,686,568 B2 * 3/2010 Moors ..... F01D 5/225 415/1
7,988,410 B1 * 8/2011 Liang ..... F01D 9/04 415/115
2005/0100439 A1 * 5/2005 Greim ..... F01D 5/225 415/173.5
2006/0237914 A1 * 10/2006 Li ..... F16J 15/445 277/415
2007/0009349 A1 * 1/2007 Ward, Jr. ..... F01D 9/04 415/115
2013/0017072 A1 1/2013 Ali et al.
2013/0230379 A1 * 9/2013 Ali ..... F01D 5/225 415/1
2015/0184750 A1 * 7/2015 Kuwannura ..... F01D 11/127 277/355

FOREIGN PATENT DOCUMENTS

JP 54-103910 8/1979
JP 58-165201 11/1983
JP 60-52306 4/1985
JP 62-116101 7/1987
JP 8-1264 1/1996
JP 2006-104952 4/2006
JP 2007-120476 5/2007
JP 2008-75644 4/2008
JP 2008-184974 8/2008
JP 2010-77882 4/2010
JP 2011-52645 3/2011
WO 2012/001997 1/2012

OTHER PUBLICATIONS

Notice of Allowance dated May 10, 2016 in corresponding Japanese Application No. 2015-509933 (with English translation).
Notice of Allowance dated Jun. 27, 2016 in corresponding Korean Application No. 10-2015-7022298 (with English translation).
International Search Report dated Mar. 25, 2014 in corresponding International Application No. PCT/JP2014/052095.
Written Opinion of the International Searching Authority dated Mar. 25, 2014 in corresponding International Application No. PCT/JP2014/052095.
Extended European Search Report dated Nov. 22, 2016 in corresponding European Application No. 14779746.8.
Office Action dated Mar. 9, 2016 in corresponding Chinese Patent Application No. 201480017939.7 (with partial English translation).

* cited by examiner

ROTATING MACHINE

TECHNICAL FIELD

The present invention relates to a rotating machine, and more particularly, to a rotating machine including a seal mechanism configured to reduce leakage loss.

Priority is claimed on Japanese Patent Application No. 2013-078029, filed Apr. 3, 2013, the content of which is incorporated herein by reference.

BACKGROUND ART

In a rotating machine such as a steam turbine, a gas turbine, or the like, in order to prevent leakage of a working fluid such as steam or the like from a gap formed between a stationary side (a casing) and a rotary side (a rotor blade), a seal mechanism is used (for example, see Patent Literature 1).

For example, in order to reduce the working fluid that passes stator blades from passing through the gap (a rotor blade tip cavity) between the rotor blade and the casing, for example, a technology of forming a seal member such as a sealing fin or the like extending from an inner circumference of the casing toward the rotor blade is known.

CITATION LIST

Patent Literature

[Patent Literature 1] Japanese Unexamined Patent Application, First Publication No. 2006-104952

[Patent Literature 2] U.S. Pat. No. 7,004,475

SUMMARY OF INVENTION

Technical Problem

In recent times, there are cases in which self-excited vibration such as low frequency vibration or the like occurs in rotating machines. The self-excited vibration is caused by irregular pressure distribution generated in a cavity between sealing fins in a circumferential direction when a flow (a swirl flow) having a strong velocity component in a circumferential direction (a swirl component, a tangential velocity component) after passing the stator blades passes the sealing fins.

In light of this, a structure configured to reduce/attenuate a swirl component is needed in a seal mechanism of a rotating machine. As such a structure, similar to an apparatus disclosed in Patent Literature 2, a technology of installing a baffle plate in a rotor blade tip cavity is known.

However, a seal member used in the apparatus has a honeycomb structure constituted by sealing fins and a baffle plate. Specifically, since the honeycomb structure is a structure in which the sealing fins are divided by the baffle plate extending in the axial direction and the working fluid does not enter the structure because of the continuous baffle plate, a swirl reduction effect is low.

An object of the present invention is directed to providing a rotating machine including a seal mechanism capable of enhancing a reduction effect of a swirl flow.

Solution to Problem

In order to achieve the aforementioned objects, according to a first aspect of the present invention, a rotating machine includes: a rotor having a rotor main body that rotates about an axis thereof, and a rotor blade disposed to extend from the rotor main body outward in a radial direction; a casing disposed to surround the rotor from an outer circumferential side and having a cavity that a tip of the rotor blade enters; a plurality of sealing fins extending from an inner circumferential surface of the cavity of the casing toward the tip of the rotor blade and configured to seal a space between the casing and the rotor blade; and swirl breakers disposed between the plurality of sealing fins, extending from the inner circumferential surface of the cavity of the casing inward in the radial direction, and having swirl flow collision surfaces with which a swirl flow collides and swirl flow transmission parts formed at least parts of the swirl flow collision surfaces and through which the swirl flow passes in a circumferential direction, wherein the swirl breakers are formed of a plate-shaped body, and the swirl flow collision surfaces are formed to have different angles with respect to the axial direction at a proximal end side and a tip side.

According to the above-mentioned configuration, as the swirl breakers are disposed between the sealing fins and the swirl flow collides with the swirl breakers, a dynamic pressure of the swirl flow can be attenuated by the swirl breakers to reduce the swirl flow.

In addition, as the swirl flow transmission parts are formed at the swirl flow collision surfaces, since the swirl flow passes through the swirl flow transmission parts to flow in the circumferential direction at positions of the swirl flow collision surfaces in the radial direction, a reduction effect of the swirl flow can be enhanced.

In addition, according to the above-mentioned configuration, the swirl breakers that are more appropriate for behavior of the swirl flow that repeatedly bounces between the sealing fin of the upstream side and the sealing fin of the downstream side can be provided.

According to a second aspect of the present invention, a rotating machine includes: a rotor having a rotor main body that rotates about an axis thereof, and a rotor blade disposed to extend from the rotor main body outward in a radial direction; a casing disposed to surround the rotor from an outer circumferential side and having a cavity that a tip of the rotor blade enters; a plurality of sealing fins extending from an inner circumferential surface of the cavity of the casing toward the tip of the rotor blade and configured to seal a space between the casing and the rotor blade; and swirl breakers disposed between the plurality of sealing fins, extending from the inner circumferential surface of the cavity of the casing inward in the radial direction, and having swirl flow collision surfaces with which a swirl flow collides and swirl flow transmission parts formed at least parts of the swirl flow collision surfaces and through which the swirl flow passes in a circumferential direction, wherein the swirl flow collision surfaces are formed to be inclined with respect to the axial direction to be perpendicular to a flow direction of the swirl flow.

In the rotating machine, the swirl flow transmission parts may be gaps formed between the swirl flow collision surfaces and at least one of the sealing fins of one side in an axial direction and another of the sealing fins of the other side in the axial direction.

According to the above-mentioned configuration, the swirl flow transmission parts can be formed with a simpler configuration.

In the rotating machine, the swirl breakers may be formed of a plate-shaped body having at least one hole, and the swirl flow transmission parts may be the at least one hole.

According to the above-mentioned configuration, as a diameter, a shape, the number, disposition, or the like, of the hole is adjusted, the swirl breakers that are more appropriate for the behavior of the swirl flow can be provided.

In the rotating machine, dimple processing may be performed on at least one of the swirl flow collision surfaces of the swirl breakers and the surfaces of the sealing fins.

According to the above-mentioned configuration, in comparison with the case in which the swirl collision surfaces and the sealing fins are planar, since energy loss due to friction of the swirl flow with the swirl breakers and the sealing fins is increased, a reduction effect of a tangential velocity component included in steam can be increased.

In the rotating machine, the swirl breakers may have a cross-sectional shape having a wave form.

According to the above-mentioned configuration, in addition to separated flows having vorticity in the radial direction, a plurality of small-scaled vortices having vorticity in the axial direction/the circumferential direction are generated. Accordingly, a disturbance of a flow in the space between the sealing fins is amplified, and a reduction effect of the tangential velocity component included in the steam can be increased.

In the rotating machine, the swirl breakers may be formed to have a width that reduces toward the inner circumferential side in the radial direction.

According to the above-mentioned configuration, a leak jet that passes through the sealing fins is easily introduced into the space surrounded by the sealing fins at which the swirl breakers are installed, and an effect of the swirl breakers can be further enhanced.

Advantageous Effects of Invention

According to the present invention, as the swirl breakers are disposed between the sealing fins, and the swirl flow collides with the swirl breakers, the dynamic pressure of the swirl flow can be attenuated by the swirl breakers to reduce the swirl flow. In addition, as the swirl flow transmission parts are formed at the swirl collision surfaces, the swirl flow can easily pass through the swirl flow transmission parts, and a reduction effect of the swirl flow can be enhanced.

DESCRIPTION OF EMBODIMENTS (First Embodiment)

Hereinafter, a steam turbine serving as a rotating machine of a first embodiment of the present invention will be described based on the accompanying drawings.

Figure 1:
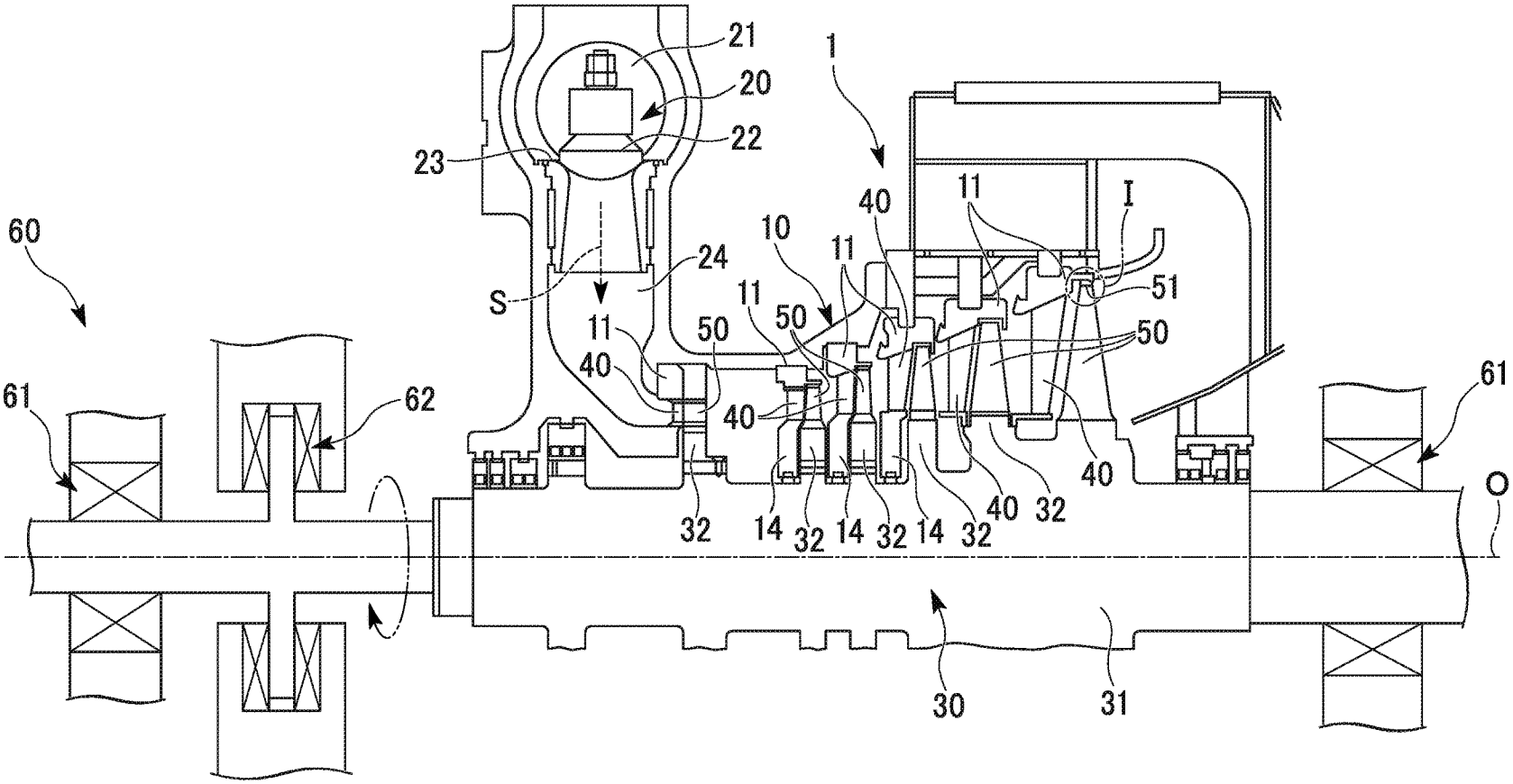
FIG. 1 is a cross-sectional view showing a schematic configuration of a steam turbine according to a first embodiment of the present invention.

As shown in FIG. 1, a steam turbine 1 of the embodiment includes a casing 10, adjustment valves 20 configured to adjust an amount and a pressure of steam S introduced into the casing 10, a rotor 30 rotatably installed inside the casing 10 and configured to transmit power to a machine such as a generator (not shown) or the like, stator blades 40 held by the casing 10, rotor blades 50 installed at the rotor 30, and a bearing unit 60 configured to support the rotor 30 such that the rotor 30 is rotatable about an axis thereof.

The casing 10 has an internal space, which is hermetically sealed, and serves as a flow path of the steam S. A ring-shaped partition plate outer wheel (a stationary annular body) 11 through which the rotor 30 is inserted is strongly fixed to an inner wall surface of the casing 10.

The plurality of adjustment valves 20 are attached to the inside of the casing 10. The plurality of adjustment valves 20 each include an adjustment valve chamber 21 into which the steam S is introduced from a boiler (not shown), a valve body 22 and a valve seat 23. When the valve body 22 is separated from the valve seat 23, a steam flow path is opened, and the steam S is introduced into an internal space of the casing 10 via a steam chamber 24.

The rotor 30 includes a rotor main body 31, and a plurality of disks 32 extending from an outer circumference of the rotor main body 31 in a radial direction of the rotor 30 (hereinafter, simply referred to as a radial direction). The rotor 30 is configured to transmit rotational energy to a machine such as a generator (not shown) or the like.

The bearing unit 60 includes a journal bearing device 61 and a thrust bearing device 62, and rotatably supports the rotor 30.

The stator blades 40 constitute annular stator blade groups in which a plurality of the blades extend from the casing 10 toward the inner circumferential side, are radially disposed to surround the rotor 30, and are held at the above-mentioned partition plate outer wheel 11. Inner sides in the radial direction of the stator blades 40 are connected to a ring-shaped partition plate inner wheel 14 or the like through which the rotor 30 is inserted.

Six annular stator blade groups constituted by the plurality of stator blades 40 are formed in an axial direction of the rotor 30 (hereinafter, simply referred to as an axial direction) at intervals, and pressure energy of the steam S is converted into velocity energy to be introduced into the rotor blades 50 immediately downstream.

The rotor blades 50 are strongly attached to an outer circumferential section of the disk 32 included in the rotor 30, and the plurality of annular rotor blade groups, which are radially disposed, are provided downstream from the annular stator blade groups.

These annular stator blade groups and annular rotor blade groups are disposed in pairs at each stage. That is, the steam turbine 1 is constituted in six stages. Among the stages, tip sections of the rotor blades 50 in the final stage are referred to as shrouds 51 configured to connect tip sections of rotor blades neighboring in a circumferential direction of the rotor 30 (hereinafter, simply referred to as a circumferential direction).

Figure 2:
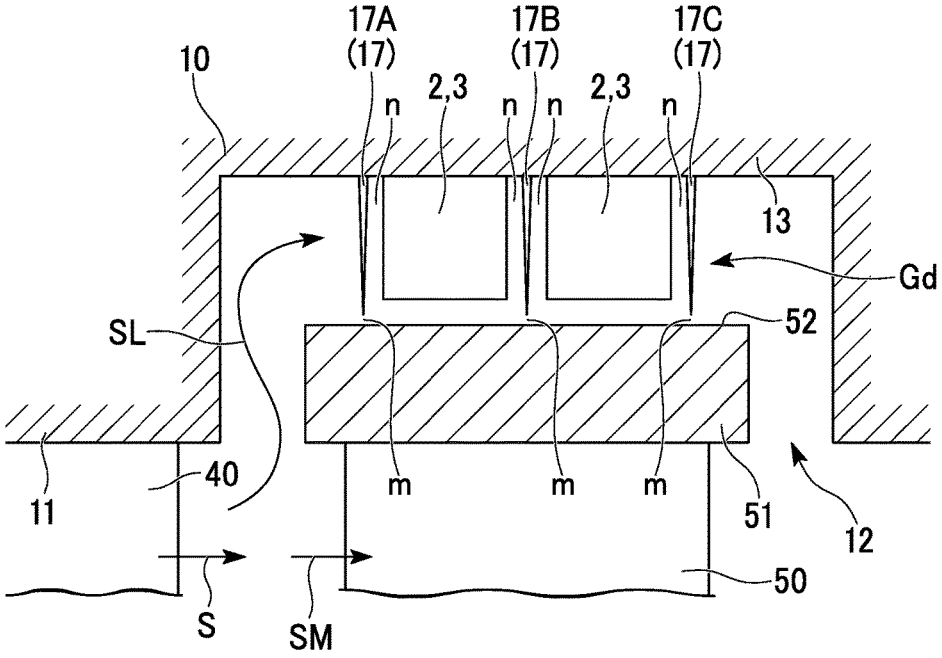
FIG. 2 is an enlarged cross-sectional view of a portion I of FIG. 1, showing an enlarged cross-sectional view of a major part of a sealing fin of the steam turbine according to the first embodiment.

As shown in FIG. 2, an annular groove 12 (a cavity) having a diameter that increases from an inner circumferential section of the partition plate outer wheel 11 and using an inner circumferential surface of the casing 10 as a bottom section 13 is formed downstream in the axial direction of the partition plate outer wheel 11. The shrouds 51 are accommodated in the annular groove 12, and the bottom section 13 is opposite to outer circumferential surfaces 52 of the shrouds 51 via a gap Gd in the radial direction.

Three sealing fins 17 (17A to 17C) extending toward the shrouds 51 in the radial direction are formed at the bottom section 13. The sealing fins 17 (17A to 17C) extend from the bottom section 13 toward the outer circumferential surfaces 52 of the shrouds 51 at the inner circumferential side, and extend in the circumferential direction. The sealing fins 17 (17A to 17C) are configured to form micro gaps m with the outer circumferential surfaces 52 of the shrouds 51 in the radial direction.

A dimension of the micro gaps m is set within a range in which the sealing fins 17 (17A to 17C) do not come in contact with the rotor blades 50 in consideration of a heat growth amount of the casing 10 or the rotor blades 50, a centrifugal growth amount of the rotor blades 50, or the like.

A plurality of swirl breakers 2 are disposed between the sealing fins 17 neighboring in the axial direction at predetermined intervals in the circumferential direction. The swirl breakers 2 are disposed in the circumferential direction at equal intervals. Specifically, the swirl breakers 2 are plate-shaped bodies disposed between the sealing fin 17A and the sealing fin 17B and extending inward in the radial direction to protrude from the inner circumferential surface (the bottom section 13) of the annular groove 12 of the casing 10.

Figure 3:
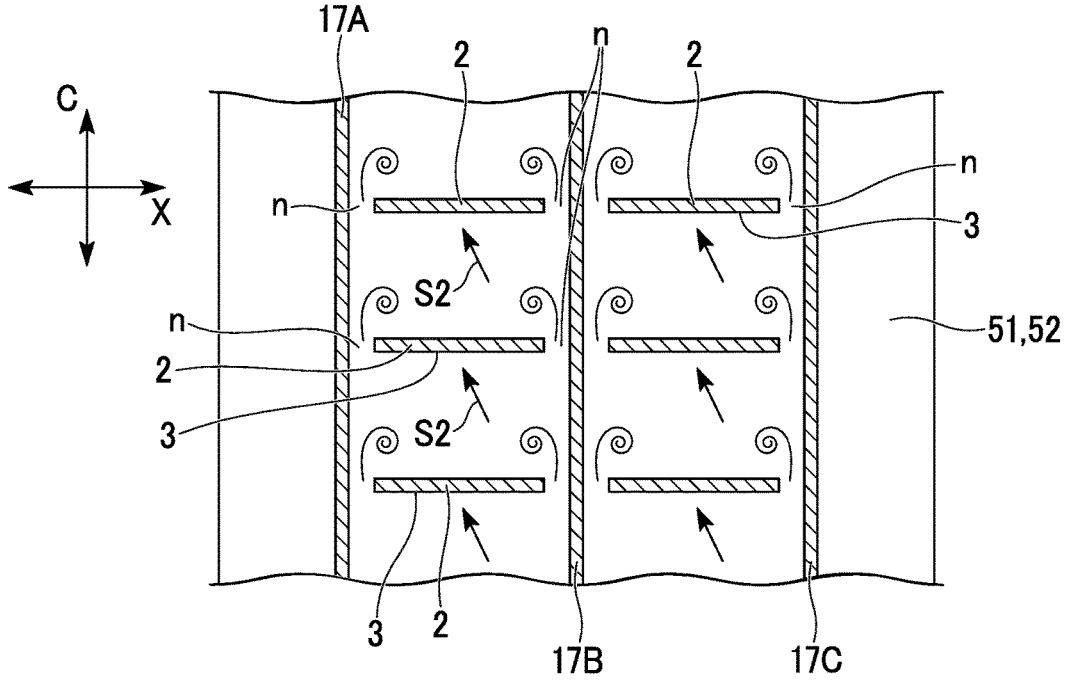
FIG. 3 is a view of the sealing fin of the steam turbine according to the first embodiment when seen from the outside in the radial direction.

As shown in FIG. 3, surfaces of the swirl breakers 2 are swirl flow collision surfaces 3 with which a swirl flow collides. The swirl flow collision surfaces 3 are disposed in the axial direction, and are directed toward one side in the circumferential direction (designated by reference character C).

In addition, gaps n serving as swirl flow transmission parts are formed between the swirl breakers 2 and the sealing fins 17 disposed at a first side (upstream) in the axial direction of the swirl breakers 2 and a second side (downstream) in the axial direction opposite to the first side. That is, the swirl breakers 2 are not connected to the sealing fins 17 in the axial direction. The dimension of the gaps n will be described below.

Here, an operation of the steam turbine 1 with this configuration will be described.

First, when the adjustment valves 20 (see FIG. 1) are in an open state, the steam S is introduced into the internal space of the casing 10 from the boiler (not shown).

The steam S introduced into the internal space of the casing 10 sequentially passes the annular stator blade group and the annular rotor blade group of each stage.

In the annular stator blade group of each stage, a velocity component in the circumferential direction of the steam S is increased while passing the stator blades 40. A majority of the steam SM out of the steam S is introduced between the rotor blades 50, and energy of the steam SM is converted into rotational energy to apply a rotational force to the rotor 30.

In addition, a portion of the steam SL (for example, about several %) out of the steam S is discharged from the stator blades 40, and then a component in the circumferential direction is increased, i.e., a swirl flow is introduced into the annular groove 12.

Here, behavior of the leaked steam SL introduced into the annular groove 12 when the swirl breakers 2 are not disposed will be described.

Figure 4:
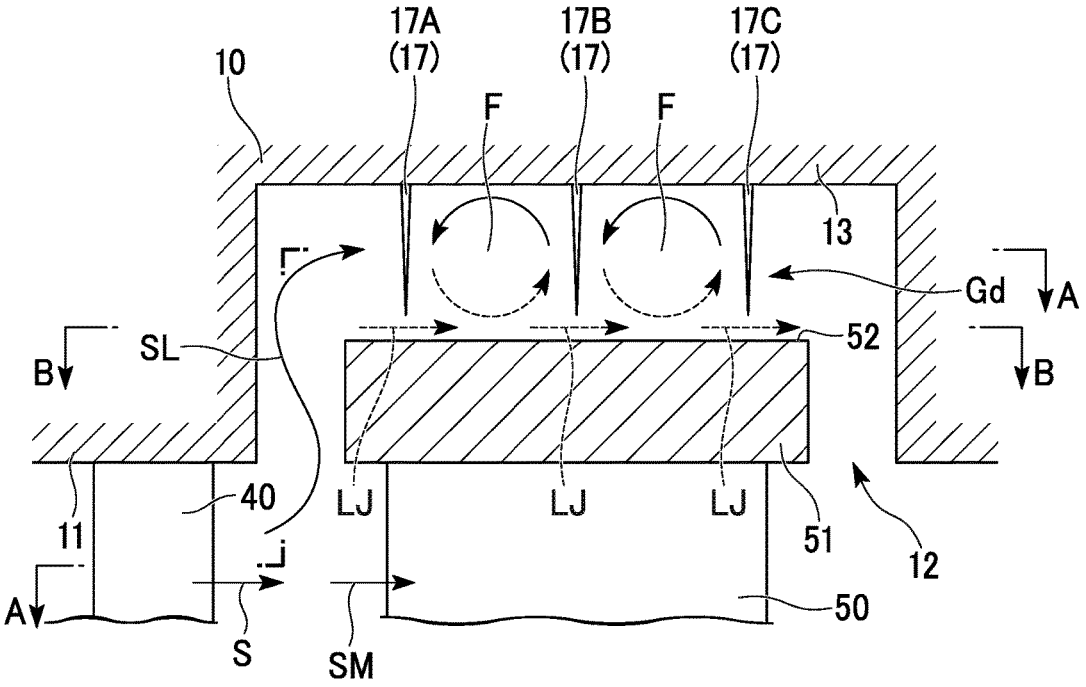
FIG. 4 is a view corresponding to FIG. 2 that describes behavior of leaked steam introduced into an annular groove when swirl breakers are not disposed.

As shown in FIG. 4, a portion of the leaked steam SL becomes a leak jet LJ having a velocity in the axial direction calculated with a function of a size of a pressure difference between the upstream side and the downstream side of the sealing fin 17A to flow toward the sealing fins 17B neighboring in the axial direction while going over the sealing fin 17A.

Figure 5:
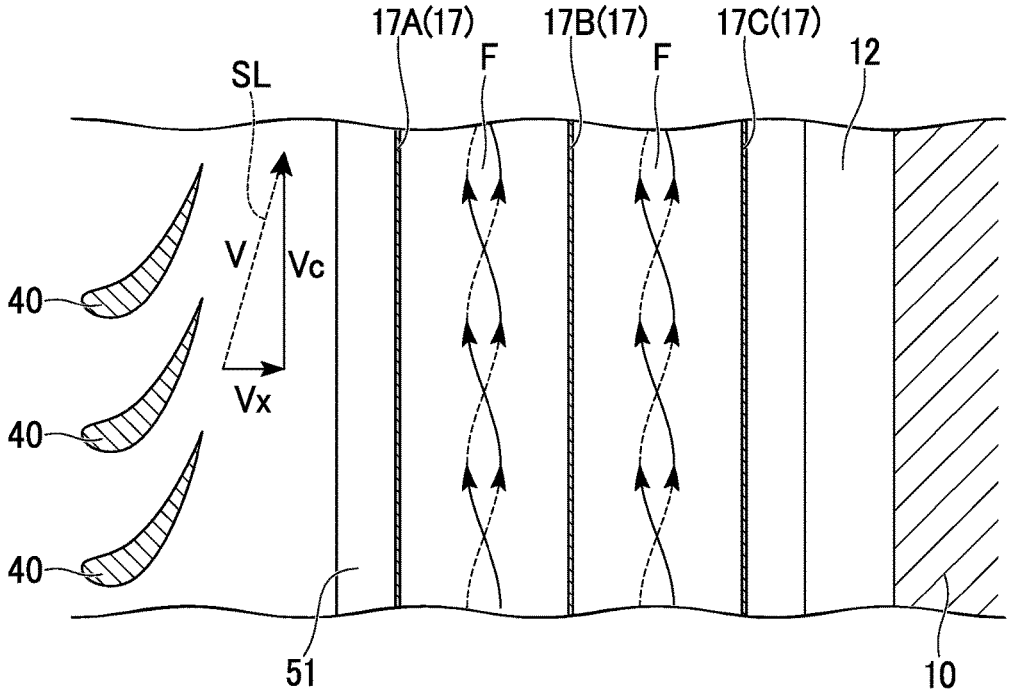
FIG. 5 is a cross-sectional view taken along line A-A of FIG. 4.

In addition, as shown in FIG. 5, the leaked steam SL flows as a swirl flow having a component Vc in the circumferential direction into a fin space F surrounded by the sealing fin 17A and the sealing fin 17B in front and rear thereof. That is, the swirl flow has a strong component Vc in the circumferential direction at an outlet of the stator blades 40, and a velocity of the component Vc in the circumferential direction is larger than a velocity component Vx in the axial direction.

Figure 6:
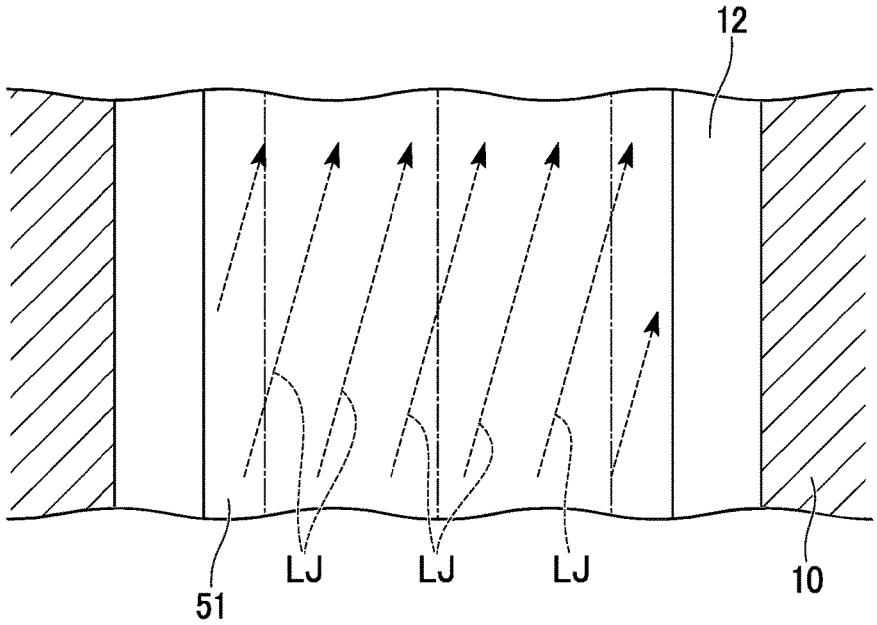
FIG. 6 is a cross-sectional view taken along line B-B of FIG. 4.

The swirl flow has a vortex shape (see FIGS. 4 and 5) in which a rotational center axis is in the circumferential direction due to viscosity of the leak jet LJ passing through the sealing fins 17. In addition, a flow in the vicinity of the leak jet LJ has a flow pattern as shown in FIG. 6.

Next, behavior of the leaked steam SL when the swirl breakers 2 are installed will be described.

Figure 7:
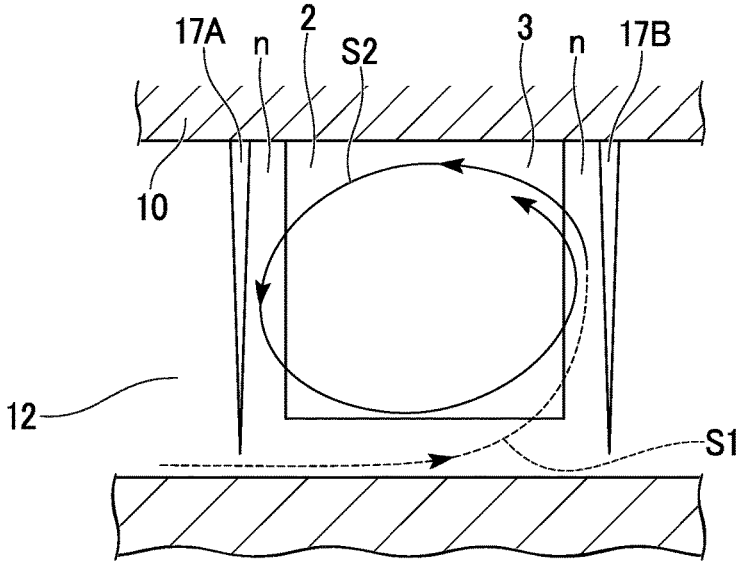
FIG. 7 is a view for describing an action of swirl breakers of the first embodiment.

As shown in FIG. 7, when a swirl flow of the leaked steam SL is introduced in a vortex shape between the two sealing fins 17 neighboring in the axial direction while going over the sealing fin 17A of the upstream side in the axial direction (designated by reference character S1), and the swirl bounces off the sealing fin 17B of the downstream side in the axial direction (designated by reference character S2). The bouncing swirl flow S2 collides with the swirl flow collision surface 3 of the swirl breaker 2 after bouncing off the sealing fin 17A of the upstream side in the axial direction. Accordingly, the swirl flow S2 is reduced.

In addition, the swirl flow S2 passes through the gaps n between the swirl breakers 2 and the sealing fins 17. That is, the swirl flow S2 escapes to the other side in the circumferential direction while a flow thereof is not completely blocked by the swirl breakers 2. Here, the gaps n between the swirl breaker 2 and the sealing fins 17 are appropriately adjusted according to an area of the swirl breaker 2 required to reduce the swirl flow S2 colliding with the swirl flow S2, and an amount of the swirl flow S2 to pass through the gaps n.

According to the embodiment, as the swirl breakers 2 are disposed between the sealing fins 17, the swirl flow collides with the swirl breakers 2. Accordingly, as a dynamic pressure of the swirl flow is attenuated by the swirl breakers 2, a tangential velocity component included in the steam SL can be reduced.

In addition, as the gaps n are formed between the swirl breakers 2 and the sealing fins 17, the swirl flow easily passes through the gaps n, and a reduction effect of the swirl flow is increased.

In addition, as the swirl flow collision surfaces 3 of the swirl breakers 2 are disposed perpendicular to a flow direction of the swirl flow, the swirl flow can be more effectively reduced.

In addition, as the gaps n between the swirl breakers 2 and the sealing fins 17 serve as the swirl flow transmission parts, the swirl flow transmission parts can be formed with a simpler configuration.

Further, in the swirl breakers 2, when the swirl flow introduced from one side in the circumferential direction can be released to the other side in the circumferential direction, angles and positions in the axial direction of the swirl breakers 2 may be different from the above-mentioned embodiment. That is, configurations of the swirl breakers 2 and the gaps n can be appropriately adjusted according to the behavior of the swirl flow.

Figure 8:
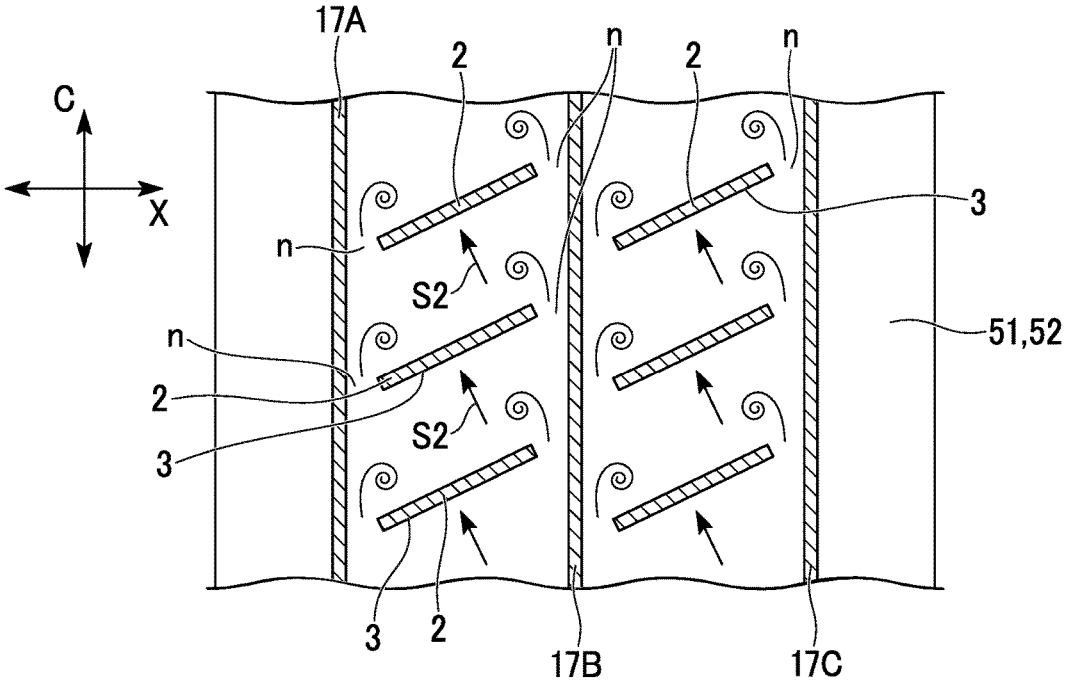
FIG. 8 is a view corresponding to FIG. 3, describing a variant of the swirl breakers of the first embodiment.

For example, as shown in FIG. 8, the swirl flow collision surfaces 3 of the swirl breakers 2 may be disposed to be inclined with respect to the axial direction (designated by reference character X). Angles of the swirl flow collision surfaces 3 with respect to the axial direction are appropriately adjusted according to the behavior of the swirl flow S2. Specifically, the swirl flow collision surfaces 3 are adjusted to be perpendicular to the flow direction of the swirl flow S2.

Figure 9:
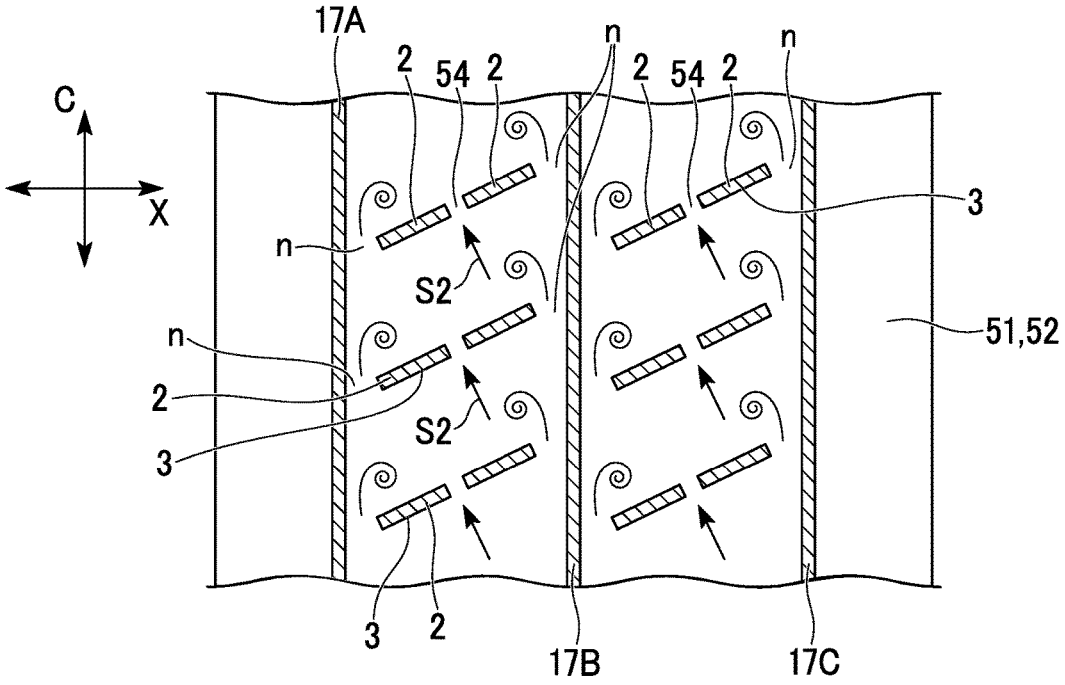
FIG. 9 is a view corresponding to FIG. 3, describing a variant of the swirl breakers of the first embodiment.

Further, the swirl breakers 2 may not be continuously formed. For example, as shown in FIG. 9, slits 54 in the radial direction may be formed at centers in an extension direction in the axial direction of the swirl breakers 2.

Figure 10:
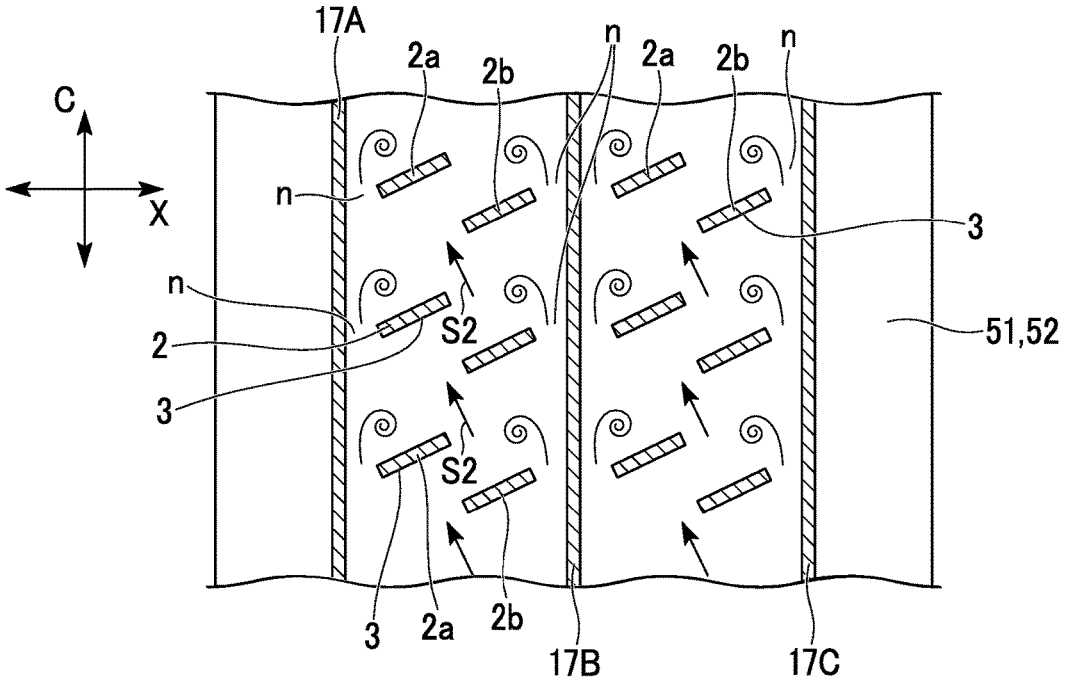
FIG. 10 is a view corresponding to FIG. 3, describing a variant of the swirl breakers of the first embodiment.

In addition, as shown in FIG. 10, swirl breakers 2*a* of a first side in the axial direction and swirl breakers 2*b* of a second side in the axial direction may be configured to be alternately disposed in the circumferential direction.

In addition, the gaps n are preferably formed between the swirl breakers 2 and the sealing fin of the downstream side (the sealing fin 17B of FIG. 7) so that the swirl flow S2 can arrive at the vicinity of the casing 10 throughout the circumferential direction and then collide with the swirl breakers 2 of a downstream side in a swirl direction.

Figure 11:
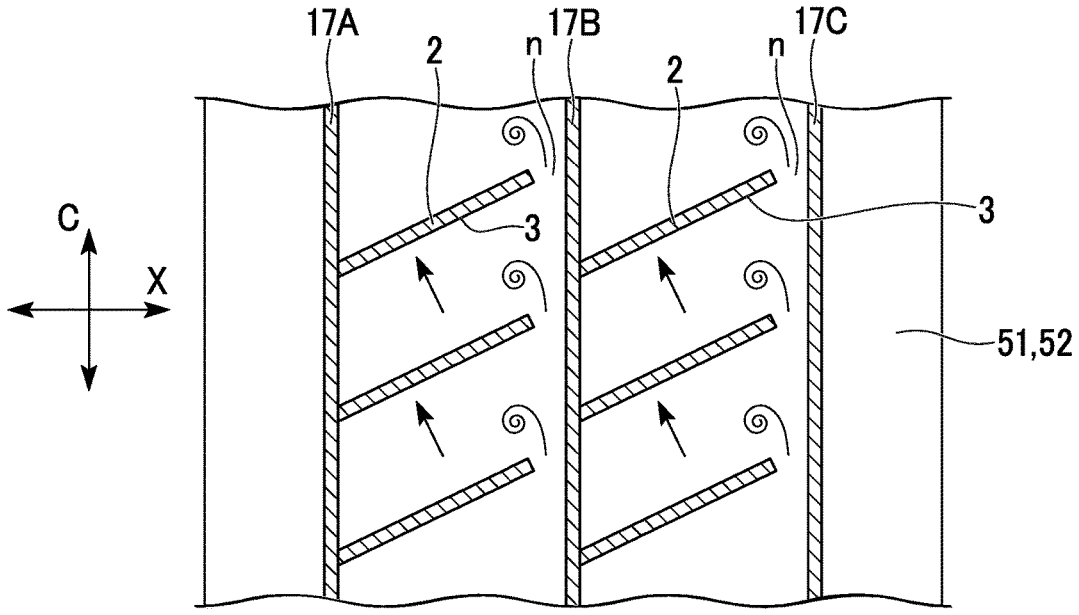
FIG. 11 is a view corresponding to FIG. 3, describing a variant of the swirl breakers of the first embodiment.

For example, as shown in FIG. 11, only one sides in the axial direction of the swirl breakers 2 may be configured to be connected to the sealing fins 17. That is, the gaps n may be configured to be formed only at the second sides in the axial direction of the swirl breakers 2.

Figure 12:
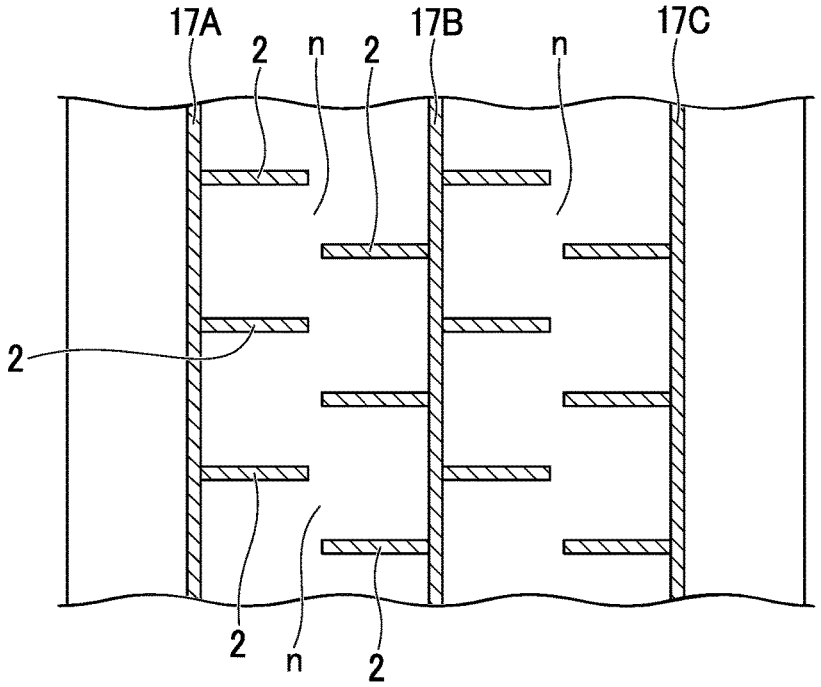
FIG. 12 is a view corresponding to FIG. 3, describing a variant of the swirl breakers of the first embodiment.

Further, as shown in FIG. 12, the swirl breakers 2 having one side in the axial direction connected to the sealing fins 17 and the swirl breakers 2 having the second sides in the axial direction connected to the sealing fins 17 may be configured to be alternately disposed in the circumferential direction.

(Second Embodiment)

Hereinafter, a rotating machine of a second embodiment of the present invention will be described based on the accompanying drawings. Further, the embodiment will be described focusing on differences from the above-mentioned first embodiment, and description of the same parts will be omitted.

Figure 13:
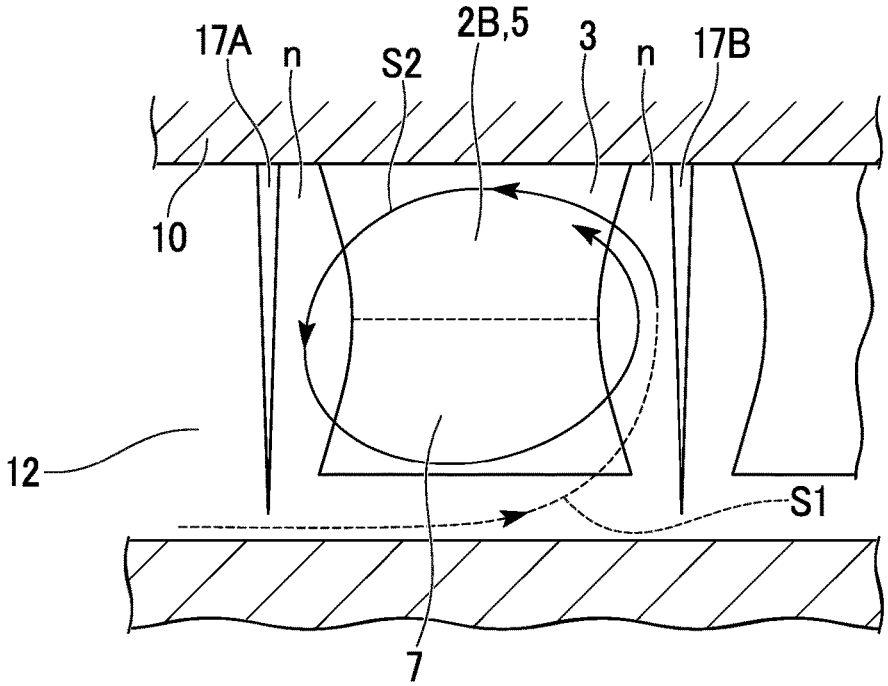
FIG. 13 is view corresponding to FIG. 7, showing swirl breakers of a second embodiment.
Figure 14:
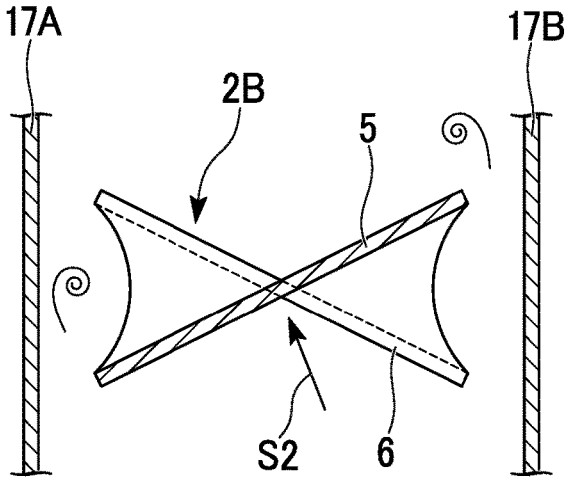
FIG. 14 is a view of the swirl breakers of the second embodiment when seen in the outside in the radial direction.

As shown in FIGS. 13 and 14, swirl breakers 2B of the rotating machine of the embodiment are configured such that inclination of the swirl flow collision surface 3 is different at a proximal end side (an outer circumferential side in the radial direction) and a tip side (an inner circumferential side in the radial direction) of the swirl breakers 2B.

Specifically, the swirl breakers 2B are constituted by proximal end sections 5 and tip sections 6, and the proximal end sections 5 and the tip sections 6 are connected to be twisted. The proximal end sections 5 have main surfaces inclined in the axial direction to be perpendicular to the flow direction of the swirl flow S2 that bounces off the sealing fin 17B of the downstream side. The tip sections 6 have angles adjusted to attenuate effectively the tangential velocity component of the swirl flow S2 that bounces off the sealing fin 17A of the upstream side.

According to the embodiment, the swirl breakers that are more appropriate for the behavior of the swirl flow S2 that repeatedly bounces between the sealing fin 17A of the upstream side and the sealing fin 17B of the downstream side can be provided.

(Third Embodiment)

Hereinafter, a rotating machine of a third embodiment of the present invention will be described based on the accompanying drawings. Further, the embodiment will be described focusing on differences from the above-mentioned first embodiment, and description of the same parts will be omitted.

Figure 15:
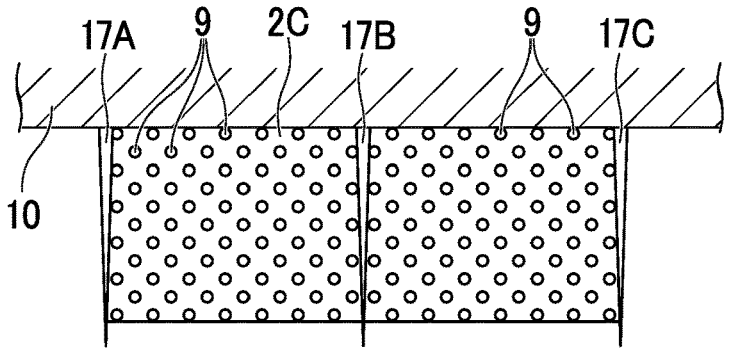
FIG. 15 is a view corresponding to FIG. 7, showing swirl breakers of a third embodiment.

As shown in FIG. 15, swirl breakers 2C of the embodiment are formed of plate-shaped porous bodies having a plurality of holes 9, and both ends in the axial direction are connected to the sealing fins 17. That is, the plurality of holes 9 serve as the swirl flow transmission parts.

According to the embodiment, as the swirl breakers 2C and the sealing fins 17 are connected, stiffness of the sealing apparatus can be increased.

Figure 16:
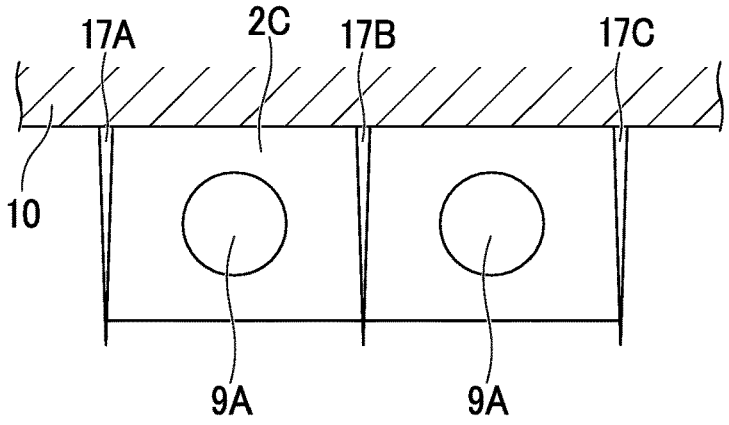
FIG. 16 is a view corresponding to FIG. 7, showing swirl breakers of a variant of the third embodiment.
Figure 17:
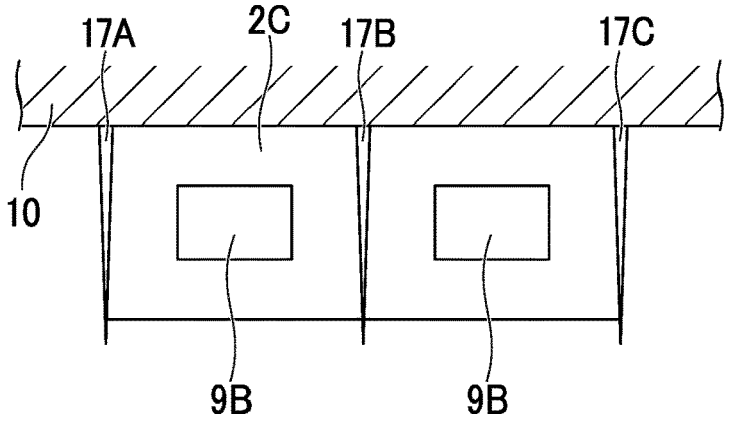
FIG. 17 is a view corresponding to FIG. 7, showing swirl breakers of a variant of the third embodiment.

Further, a diameter, a shape, the number, disposition, and so on, of the holes 9 can be appropriately varied. For example, as shown in FIG. 16, single holes 9A may be disposed at substantially centers of the swirl breakers 2C. In addition, as shown in FIG. 17, single rectangular holes 9B may be disposed at substantially centers of the swirl breakers 2C. In this way, as the configuration of the holes is varied, the swirl breakers that are more appropriate for the behavior of the swirl flow can be provided.

(Fourth Embodiment)

Hereinafter, a rotating machine of a fourth embodiment of the present invention will be described based on the accompanying drawings.

Figure 18:
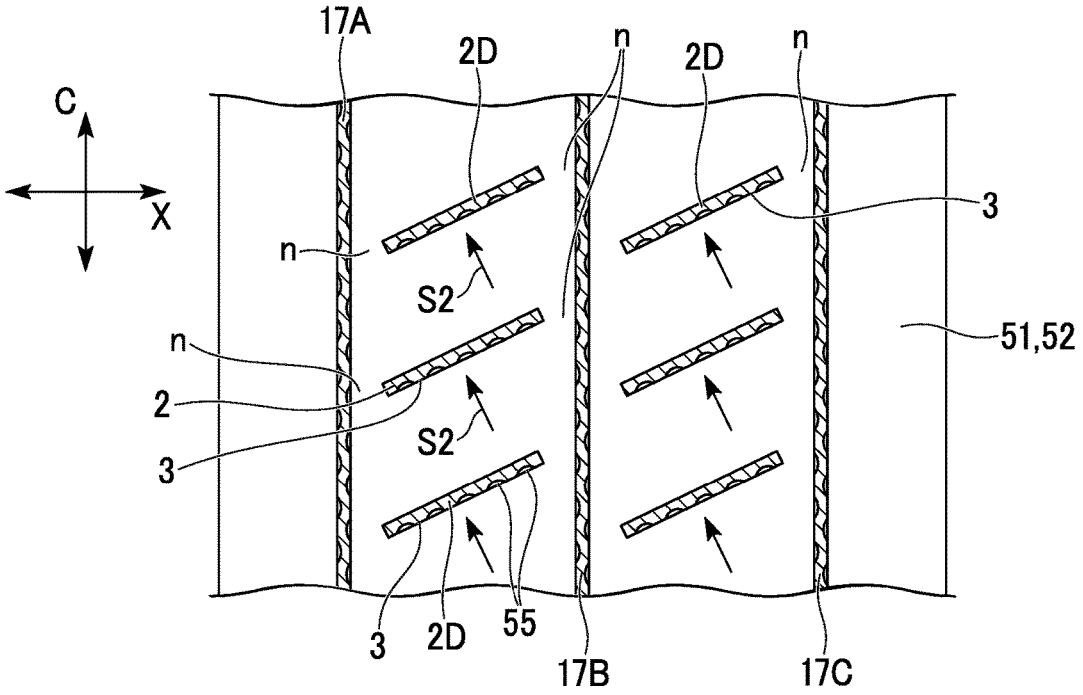
FIG. 18 is a view corresponding to FIG. 3, showing swirl breakers of a fourth embodiment.
Figure 19:
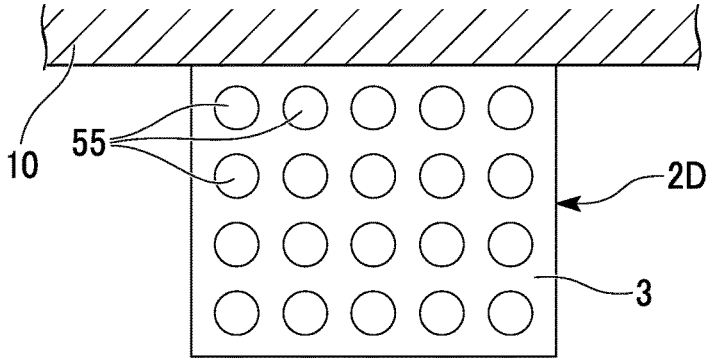
FIG. 19 is a view showing a swirl flow collision surface, which is a front view of the swirl breaker of the fourth embodiment.

As shown in FIGS. 18 and 19, dimple processing (concavo-convex processing like a surface of a golf ball) is performed on swirl flow collision surfaces 3 of swirl breakers 2D and surfaces of the sealing fins 17 of the embodiment. That is, a plurality of regularly arranged concave sections 55 are formed on the swirl flow collision surfaces 3 and the surfaces of the sealing fins 17.

The concave sections 55 may be hemispherical concave sections or may be conical concave sections. Alternatively, the concave sections 55 may be pyramidal concave sections such as a hexagonal pyramids or the like. In addition, the dimple processing may be performed on either the swirl collision surfaces 3 or the sealing fins 17, and need not be performed on both the swirl flow collision surfaces 3 and the surfaces of the sealing fins 17.

According to the embodiment, in comparison with the case in which the swirl collision surfaces 3 and the sealing fins 17 are planar, since energy loss due to friction of the swirl flow with the swirl breakers 2D and the sealing fins 17 is increased, a reduction effect of the tangential velocity component included in the steam SL is increased.

(Fifth Embodiment)

Hereinafter, a rotating machine of a fifth embodiment of the present invention will be described based on the accompanying drawings.

Figure 20:
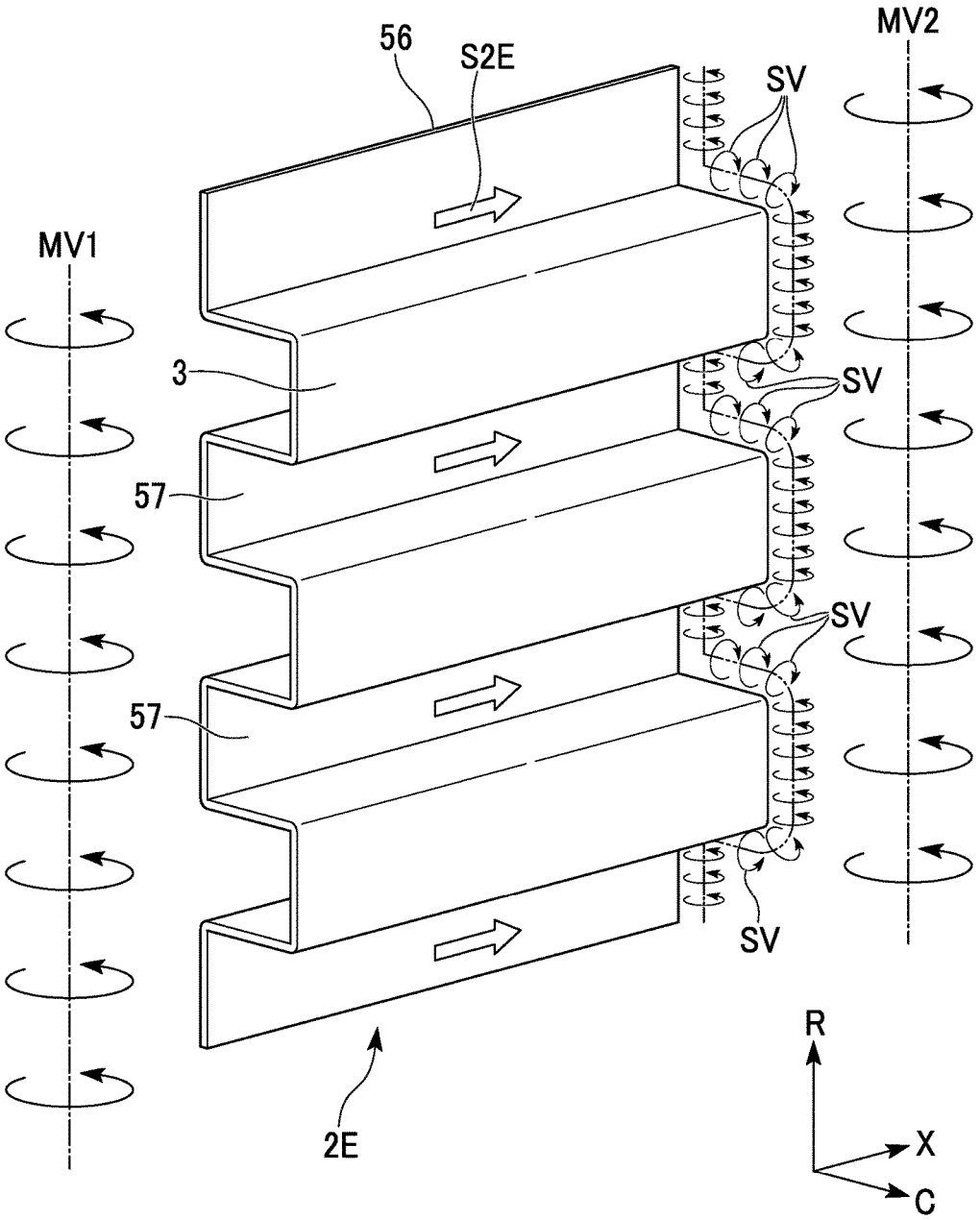
FIG. 20 is a perspective view of a swirl breaker of a fifth embodiment.

As shown in FIG. 20, a swirl breaker 2E of the embodiment has a cross-sectional shape having a wave form when seen from a direction along a connection side 56 to a bottom surface 13 (see FIG. 2). In other words, the swirl breaker 2E of the embodiment is formed in a wave form that is continuously curved in one direction perpendicular to the main surface and an opposite direction thereof from a proximal end side (an outer circumferential side in the radial direction designated by reference character R) and a tip side (an inner circumferential side in the radial direction R). The wave form may be a rectangular wave pattern or a sine wave pattern.

In addition, as the swirl breaker 2E is formed in a wave form, a depth of a chamfer 57 (a concave line) parallel to the connection side 56 formed at the swirl collision surface 3 may become deeper downstream (as shown by an arrow S2E).

According to the embodiment, in addition to separated flows MV1 and MV2 having vorticity in the radial direction R formed by the swirl breakers 2 from the first embodiment to the fourth embodiment, a plurality of small-scaled vortices SV having vorticity in an axial direction X/a circumferential direction C are generated. Accordingly, disturbance of a flow in a space between the sealing fins 17 (see FIG. 2) is amplified, and a reduction effect of the tangential velocity component included in the steam SL is increased.

Figure 21:
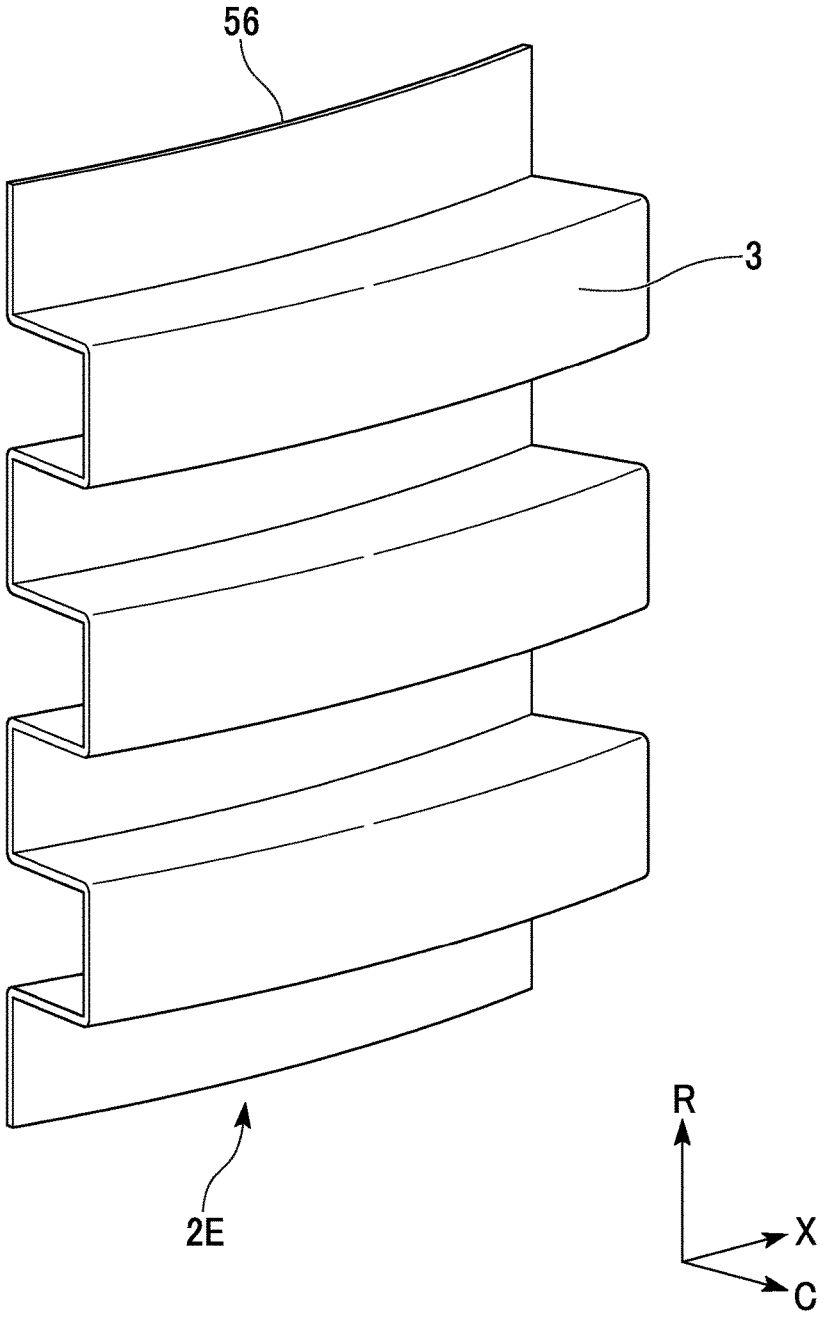
FIG. 21 is a perspective view of a variant of the swirl breaker of the fifth embodiment.

Further, as shown in FIG. 21, the swirl breaker 2E may be formed in a convex or concave arc shape toward the swirl flow S2 when seen in a direction from the proximal end side (the outer circumferential side in the radial direction R) toward the tip side (the inner circumferential side in the radial direction R). That is, the swirl flow collision surface 3 may be formed in a curved shape.

Figure 22:
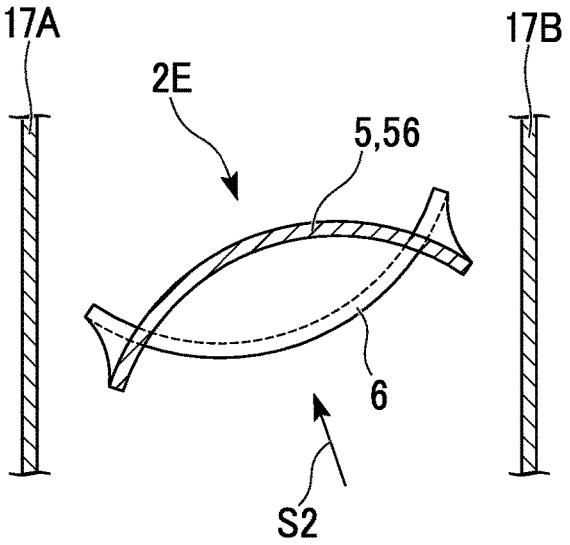
FIG. 22 is a view of the swirl breaker of the fifth embodiment when seen from the outside in the radial direction.

In addition, as shown in FIG. 22, in the swirl breaker 2E, the proximal end section 5 (an outer circumferential side in the radial direction, the connection side 56) may have a concave arc shape toward the swirl flow S2, and the tip section 6 (an inner circumferential side in the radial direction) may have a convex arc shape toward the swirl flow S2. The proximal end section 5 and the tip section 6 may be smoothly connected to form a three-dimensional twisted shape.

(Sixth Embodiment)

Hereinafter, a rotating machine of a sixth embodiment of the present invention will be described based on the accompanying drawings.

Figure 23:
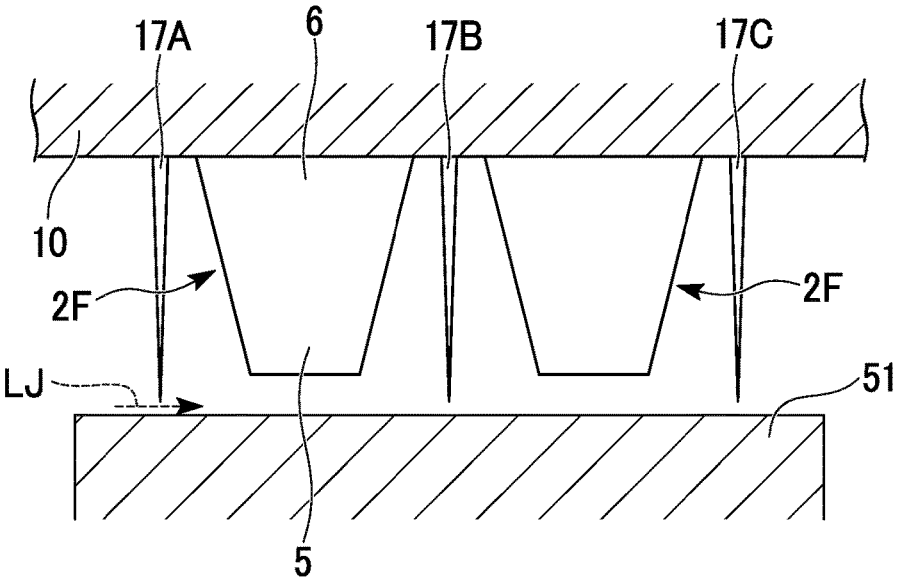
FIG. 23 is a view corresponding to FIG. 7, showing swirls breaker of a sixth embodiment.

As shown in FIG. 23, swirl breakers 2F of the embodiment have shapes in which a width is reduced from the proximal end sections 5 (the outer circumferential sides in the radial direction) toward the tip sections 6 (the inner circumferential sides in the radial direction). Specifically, the swirl flow collision surfaces 3 of the swirl breakers 2F have trapezoidal shapes in which the longer bases are connected to the casing and the shorter bases are disposed at the shroud 51 side.

According to the embodiment, the leak jet LJ that passes through the sealing fins 17 can be easily introduced into the space surrounded by the sealing fins 17 at which the swirl breakers 2F are installed, and an effect of the swirl breakers 2F can be further increased.

Figure 24:
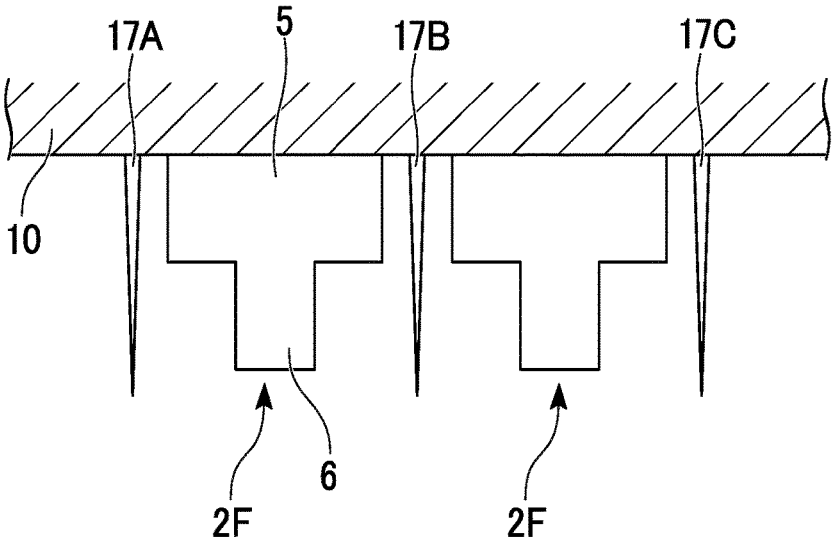
FIG. 24 is a view corresponding to FIG. 7, showing a variant of the swirl breakers of the sixth embodiment.

Further, the swirl breakers 2F of the embodiment are not limited to the shapes shown in FIG. 23. For example, as shown in a variant of FIG. 24, the surfaces may have stepped shapes in which halves of the proximal end section 5 sides have the same width as the swirl breakers 2 of the first embodiment and halves of the tip section 6 sides have smaller widths than the halves of the proximal end sides.

Figure 25:
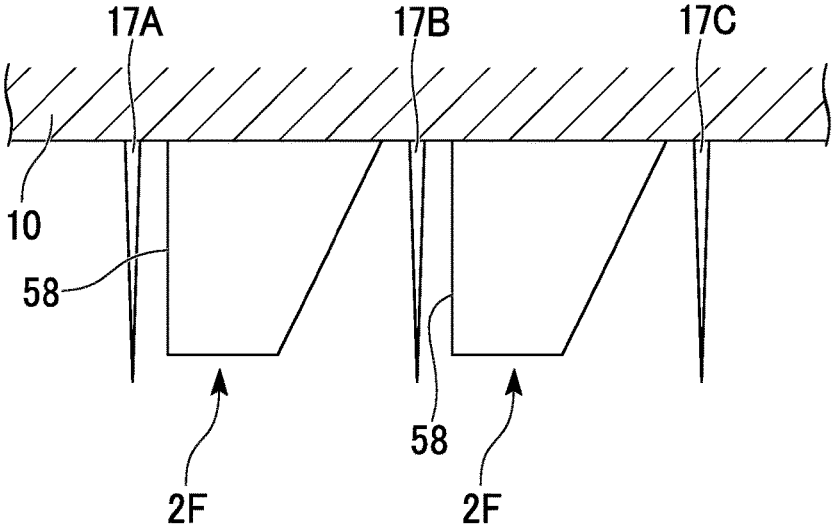
FIG. 25 is a view corresponding to FIG. 7, showing a variant of the swirl breakers of the sixth embodiment.

In addition, as shown in a variant of FIG. 25, trapezoidal shapes in which sides 58 facing the upstream sealing fins 17 are parallel to the sealing fins 17 may be used.

Further, the technical scope of the present invention is not limited to the above-mentioned embodiments but various modifications may be made without departing from the spirit of the present invention. In addition, the above-mentioned features described in the plurality of embodiments may be arbitrarily combined.

For example, the swirl breakers are not limited to planar shapes but may have curved plate shapes. In addition, while the outer circumferential surfaces 52 of the shrouds 51 of the embodiments have a planar shape, the swirl breakers of the present invention may also be applied to shrouds having steps formed at the outer circumferential surfaces 52.

REFERENCE SIGNS LIST

1 steam turbine
2 swirl breaker
3 swirl flow collision surface
5 proximal end section
6 tip section
9, 9A, 9B hole (swirl flow transmission part)
10 casing
11 partition plate outer wheel
12 annular groove (cavity)
13 bottom section
14 partition plate inner wheel
17, 17A, 17B, 17C sealing fin
20 adjustment valve
21 adjustment valve chamber
22 valve body
23 valve seat
30 rotor
31 rotor main body
32 disk
40 stator blade
50 rotor blade
51 shroud
52 outer circumferential surface
54 slit
55 concave section
60 bearing unit
61 journal bearing device
62 thrust bearing device m micro gap
n gap (swirl flow transmission part)
F fin space
Gd gap
LJ leak jet
S1, S2 swirl flow
S, SL, SM steam

The invention claimed is:

1. A rotating machine comprising:

a rotor having a rotor main body that rotates about an axis thereof, and a plurality of rotor blades disposed to extend from the rotor main body outward in a radial direction;

a casing disposed to surround the rotor from an outer circumferential side and having a cavity into which tips of the rotor blades are entered;

a plurality of sealing fins extending from an inner circumferential surface of the cavity of the casing toward the tips of the rotor blades and configured to seal a space between the casing and the rotor blades; and swirl breakers disposed between the plurality of sealing fins, extending from the inner circumferential surface of the cavity of the casing inward in the radial direction, and having swirl flow collision surfaces with which a swirl flow collides and swirl flow transmission parts formed at at least parts of the swirl flow collision surfaces and through which the swirl flow passes in a circumferential direction, wherein each of the swirl breakers is formed of a plate-shaped body and includes a proximal end section and a tip section connected with the proximal end section so as to be twisted with respect to the proximal end section, and wherein the swirl flow collision surfaces are formed to have different angles with respect to the axial direction at a proximal end side and a tip side.

2. The rotating machine according to claim 1, wherein the swirl flow transmission parts are gaps formed between the swirl flow collision surfaces and at least one of the sealing fins of one side in an axial direction and another of the sealing fins of the other side in the axial direction.

3. The rotating machine according claim 1, wherein each of the swirl breakers is formed of a plate-shaped body having at least one hole as the swirl flow transmission part.

4. The rotating machine according to claim 1, wherein a plurality of dimples are formed on at least one of the swirl flow collision surfaces of the swirl breakers and the surfaces of the sealing fins.

5. The rotating machine according to claim 1, wherein the swirl breakers have a cross-sectional shape having a wave form.

6. The rotating machine according to claim 1, wherein the swirl breakers are formed to have a width that reduces toward an inner circumferential side in the radial direction.

7. A rotating machine comprising:

a rotor having a rotor main body that rotates about an axis thereof, and a plurality of rotor blades disposed to extend from the rotor main body outward in a radial direction;

a casing disposed to surround the rotor from an outer circumferential side and having a cavity into which tips of the rotor blades are entered;

a plurality of sealing fins extending from an inner circumferential surface of the cavity of the casing toward the tip of the rotor blade and configured to seal a space between the casing and the rotor blade; and swirl breakers disposed between the plurality of sealing fins, extending from the inner circumferential surface of the cavity of the casing inward in the radial direction, and having swirl flow collision surfaces with which a swirl flow collides and swirl flow transmission parts formed at at least parts of the swirl flow collision surfaces and through which the swirl flow passes in a circumferential direction, wherein the swirl flow collision surfaces are formed to be inclined with respect to an axial direction of the rotor to be perpendicular to a flow direction of the swirl flow, and wherein the swirl flow transmission parts are slits formed in the swirl breakers so as to extend in the radial direction of the axis of the rotor.

8. The rotating machine according to claim 7, wherein the swirl breakers include plate-shaped first and second swirl breakers which are separated from each other and alternately disposed in the circumferential direction, the swirl flow collision surfaces of the first and second swirl breakers are inclined with respect to the axial direction to be perpendicular to a flow direction of the swirl flow, and an end portion of the first swirl breaker faces an end portion of the second swirl breaker with respect to the flow direction of the swirl flow.

9. The rotating machine according to claim 8, wherein each of the first and second swirl breakers is formed of a plate-shaped body having at least one hole as the swirl flow transmission part.

10. The rotating machine according to claim 7, wherein a plurality of dimples are formed on at least one of the swirl flow collision surfaces of the swirl breakers and the surfaces of the sealing fins.

11. The rotating machine according to claim 8, wherein the first and second swirl breakers have a cross-sectional shape having a wave form.

12. The rotating machine according to claim 8, wherein the first and second swirl breakers are formed to have a width that reduces toward an inner circumferential side in the radial direction.

* * * * *